United States Patent [19]

Socci

[11] Patent Number: 4,984,789

[45] Date of Patent: Jan. 15, 1991

[54] ARM AND ELBOW ELEVATOR HARNESS

[76] Inventor: Roger D. Socci, 11720 Newbridge Ct., Reston, Va. 22091

[21] Appl. No.: 352,166

[22] Filed: May 15, 1989

[51] Int. Cl.[5] ..... A63B 69/00

[52] U.S. Cl. ..... 273/26 C

[58] Field of Search ..... 273/55 R, 26 C, 183 B, 273/188 R, 189 R, 189 A; 340/573; 128/77, 80 R, 80 A, 80 B, 80 C, 80 D, 80 E, 80 F, 80 G, 80 H, 80 J, 78, 88

[56] References Cited

U.S. PATENT DOCUMENTS 475,432 5/1892 Blades ..... 273/189 R 1,591,523 7/1926 Fuller ..... 273/188 R 4,417,569 11/1983 Brundy ..... 128/77

4,651,719 3/1987 Funk ..... 128/77

4,836,195 6/1989 Berrehail ..... 128/77

*Primary Examiner*—Theatrice Brown

*Attorney, Agent, or Firm*—Sam D. Walker

[57] ABSTRACT

The present invention is concerned with a device design to help teach and train baseball pitchers the correct arm and elbow action when pitching a baseball consisting of an arm elevator harness which fits around the pitcher's body and an arm and elbow elevator guide which is attached to the shoulder harness and guides the pitcher's pitching arm in the right position.

2 Claims, 3 Drawing Sheets

ARM AND ELBOW ELEVATOR HARNESS

FIELD OF THE INVENTION

The present invention relates to a pitching aid for use in baseball. More particular, the present invention relates to a arm and elbow elevator harness design to help teach the correct arm and elbow action when pitching a baseball.

BACKGROUND OF THE INVENTION

There has been a tremendous need for a device such as the arm and elbow elevator harness of the present invention to help teach and train inexperienced and experienced pitchers alike the correct arm and elbow action when pitching a baseball. Pitchers on every level of baseball, and particularly young pitchers, those in the little leagues, have all too often suffered irreparable injury to their pitching arm because they did not throw with the high elbow i.e. his pitching elbow is as high or higher than his pitching shoulder when delivering the ball to the batter, or he/she did not use the correct arm and elbow action when pitching or throwing the baseball.

The arm and elbow elevator harness of the present will teach and train pitchers how to use the correct arm and elbow action when throwing and pitching a baseball. If pitchers are able to pitch with the correct arm and elbow action or high elbow they will greatly minimize injury to their pitching arm. The correct elbow and arm action will also maximize the velocity of the pitched baseball and further enhance his pitching mechanics which will enable pitching with increased accuracy.

It is therefore an object of the present invention to provide a relatively simple device to teach and train baseball pitchers;

Another object of the present invention is to provide a relatively simple device to teach the correct arm and elbow action in pitching a baseball;

A further object of the present invention is to provide a device which will allow a baseball pitcher to utilize his full potential and reduce the possibility of injuring his arm during the pitching process.

These and other objects of the present invention will become more apparent as you proceed through the detailed description.

SUMMARY OF THE INVENTION

The present invention is concerned with a device designed to help teach and train baseball pitchers the correct arm and elbow action when pitching a baseball comprising: an an arm elevator harness which fits around the pitcher's upper body; an arm and elbow elevator guide connected to the harness at a position under the pitcher's throwing arm in a manner to allow for movement in an elyptical fashion said arm and elbow elevator guide comprising a first outer portion which contacts and guide the pitching arm and a second inner portion which is attached to the harness and wherein said inner and outer portion are connected in a manner to facilitate lateral movement of the pitcher's arm when contacted therewith and when the pitcher pitches.

DETAILED DESCRIPTION OF THE INVENTION

Figure 1:
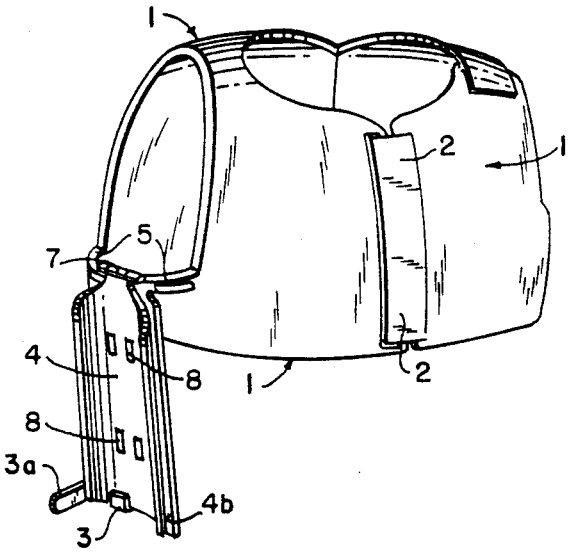
FIG. 1 is a frontal view of the shoulder harness showing the arm and elbow elevator guide connected to the harness.
Figure 2:
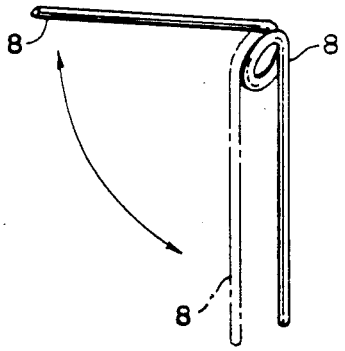
FIG. 2 shows the spring mechanism which forms part of the mechanism which holds the inner and outer portions of the elevator guide together.
Figure 3:
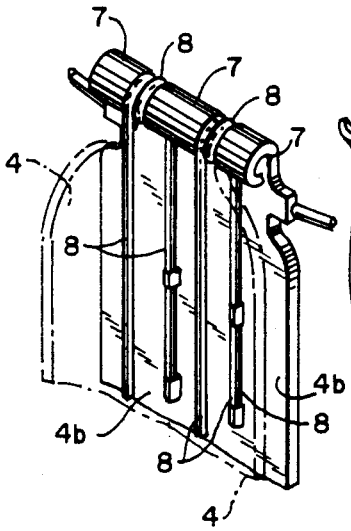
FIG. 3 shows the hinge and spring mechanism which holds the inner and outer portion of the elevator guide together.
Figure 4:
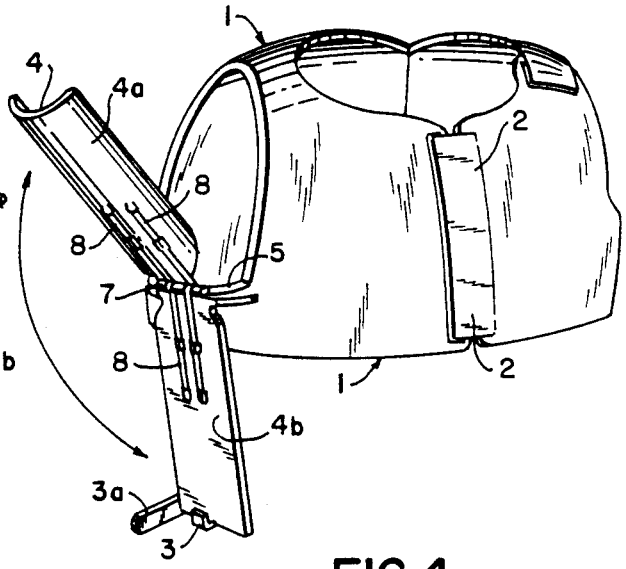
FIG. 4 shows a frontal view of the shoulder harness with the outer elevator guide in an elevated position.

Because of the tremendous need to minimize injury to baseball pitchers at all levels, it has become necessary to develop a device directed to the alleviation of this problem. The present invention discloses such a device. The device of the present invention is designed to help teach and train baseball pitchers at all levels the correct arm and elbow action to adopt when pitching a baseball. The invention further teaches the utilization of an arm elevator harness which fits around the pitchers upper body. Connected to the arm elevator harness is an elbow elevator guide attached at a position under the pitcher's throwing arm in a manner to allow for movement of the elbow elevator guide in an elyptical fashion. The arm and elevator guide comprises a first outer portion which contact and guides the pitching arm and a second inner portion which is attached to the harness. The inner and outer portions are connected in a manner to facilitate lateral movements of the pitcher's arm when attached thereto and when the pitcher pitches.

If a baseball pitcher is to throw and pitch effectively thereby utilizing his full potential and further reduce the possibility of injuring his arm he must always endeavor to throw or pitch with his pitching elbow as high or higher than his pitching shoulder when delivering a ball to a batter. The pitcher's elbow must always be leading the rest of his arm until it passes by and is in front of his throwing shoulder. In essence, the forearm and hand catches up with the elbow and passes it immediately after the elbow passes the shoulder area. When this is done correctly the baseball pitcher will surely reach full arm extension on his throwing arm's downward, backward and upward swing thereby achieving the downward plane to the batter more effectively. This causes the utilization of the pitcher's entire body as an aid when delivering the ball. When a pitcher does not throw with a high elbow he will not be using his entire body in the pitching motion or process and hence, will be putting an inordinate amount of strain on the entire pitching arm and shoulder. This is generally what causes injury to the pitcher's pitching arm.

Another condition generally affecting pitchers when the correct pitching motion is not assumed is referred to as short arming the ball to the batter. Short arming is a condition that a baseball pitcher may achieve when he throws with a dropped elbow and does not reach full arm extension on the throwing arm backswing. This is the position of the arm just prior to the delivery of the ball and when the pitcher is poised on one leg. A pitcher who short arms throws with less velosity than he is capable of because he does not get his full weight and power into the pitch. He sort of pushes or "shot puts" the ball to the batter. Although it is possible for a pitcher to achieve full arm extension or the arm's backswing with a dropped elbow, a pitcher who does this will find that he is only throwing with his arm and not with the aid of his entire body. As mentioned previously, this way of throwing may do damage to the pitcher's throwing arm and reduces his potential velocity.

The device of the present invention will allow the pitcher to throw with a high elbow to achieve full arm extension on the arm's backswing and to gather and stack his body weight for maximum power and as an aid to the arm in the delivery of the ball. This will ensure that the pitcher's arm is not "throwing by itself". Further, the device of the present invention will make it very difficult for the pitcher to short arm the ball because his entire pitching motion is guided until he delivers the ball. Guiding the arm with a high elbow makes it very difficult to short arm the ball because the pitcher realizes an immediate and dramatic loss of power when he attempts to throw with a high elbow and less than full arm extension on the arm backswing.

Upon repeated us of the device of the present invention the pitcher will find himself naturally reaching back to full arm extension on the arm 's backswing in order to throw with more power and velocity in his pitches and minimizes any pushing or shot putting of the ball to the batter which will dramatically reduce his pitching effectiveness. When pitching with an high elbow a pitcher's arm extension on the backswing will always end up on a horizontal plane. This is contrary to a short armer's extension which is always on a vertical or downward plane. A short armer's arm extension is always on a vertical plane because the pitcher is usually reaching down with his arm in an attempt to come up with more power and velocity in his pitches. This is done to compensate for the pitcher's lack of body assistance in his pitch.

The first feature of the present invention is a shoulder elevator harness 1 which is positioned on the shoulder of the pitcher like a football shoulder pads. The pitcher puts the shoulder elevator harness on much like a football player puts on shoulder pads. The shoulder elevator harness may be made from leather, plastic or the like with padding in areas which directly contact the shoulders to minimize discomfort during use. The secure the elevator harness to the shoulders security means 2 running down the front portion is utilized. These security means may include zippers, button, straps or the like. These security means may also be adjusted to accommodate different shoulder sizes.

Connected to the shoulder elevator harness underneath the pitchers throwing arm is an arm and elbow elevator guide 4. The arm and elbow elevator guide is connected to the shoulder harness in a manner to allow for movement in an elyptical fashion. This elyptical movement is accomplished by train-like tracks 5 whereupon the arm and elbow elevator guide sits. These tracks guides and facilitate movement of the arm and elbow elevator without resistance so that when the pitcher pitches his freedom of movement is not affected in any way. The tracks allows the elevator to slide forward with the pitcher's arm as he delivers the ball.

Figure 5:
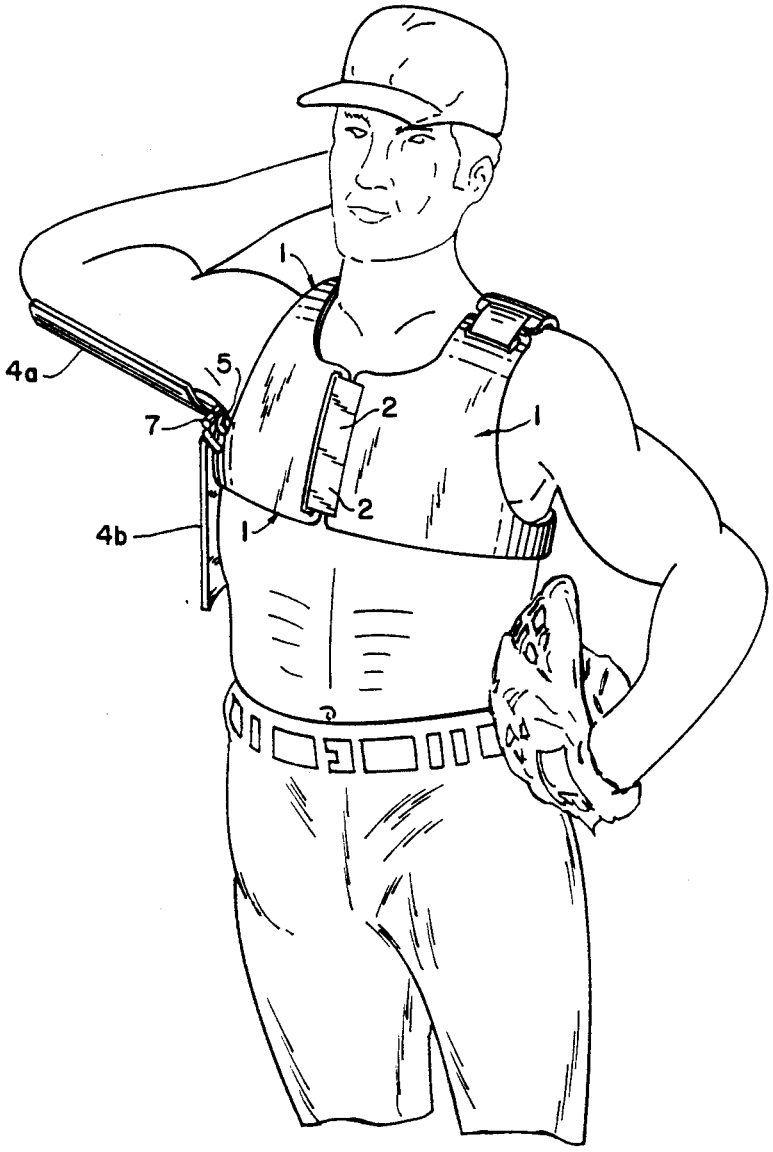
FIG. 5 shows a frontal view of a pitcher in a pitching position fitted with a shoulder harness and inner and outer elevator guide in an elevated position.
Figure 6:
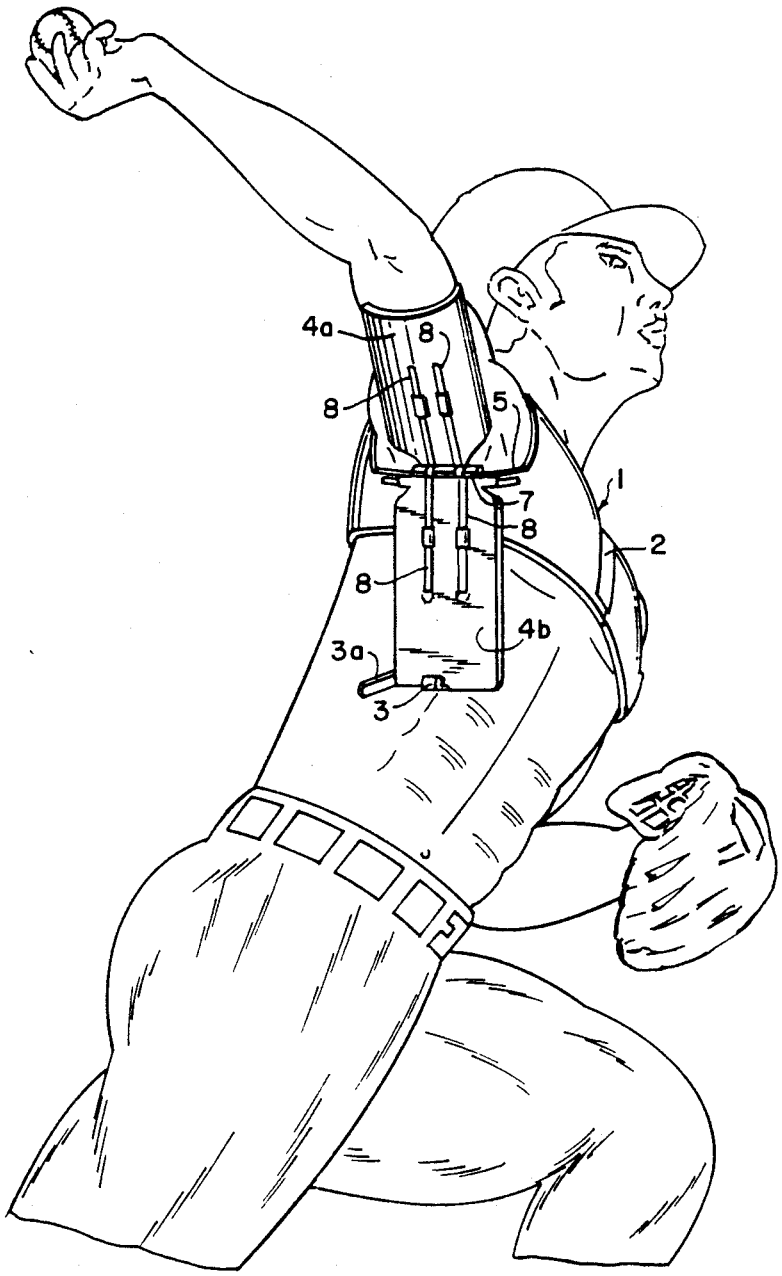
FIG. 6 shows a side view of a pitcher in a pitching position fitted with a shoulder harness and inner and outer elevator guide in an elevated position.

The arm and elbow elevator guide comprises an outer portion **4*a* and an inner portion 4*b*. When a pitcher pitches the outer portion 4*a* comes into contact with the pitcher's-arm and guides same in the correct manner and form as in FIGS. 5 and 6. The inner portion 4*b* is attached to the harness and contains means for holding the outer and inner postions together. This is accomplish by means of a latch mechanism 3 which is attached to the inner portion at the end furthest away from the point of connection with the shoulder elevator harness. Attached to the latch mechanism is lever 3*a* which become activated and release the outer portion causing same to contact the pitcher's arm as shown in FIG. 6**.

The outer and inner portions are connected in a manner to facilitate lateral movement of the pitcher's arm when contacted therewith and when the pitcher pitches. This is accomplish by means of hinge 7 and springs 8. The hinge holds the outer and inner portion together similar to the hinges of a door and allow for lateral movement of the pitcher's arm. The spring like means are attached at the hinges which causes the outer portion to elevate and contacts the pitchers arm when the lever is activated and the latch is released.

Once the pitcher is fitted with the device of the present invention his pitching is guided in the correct fashion. As the pitcher pitches the arm and elbow elevator **4*a* on the harness is engaged and springs to position when the pitcher's arm on its backswing path trips release lever 3*a* which holds arm and elbow elevator 4*a* and 4*b* together in a rest or downward position. Once engaged the arm and elbow elevator elevates and remains in the up and working position on harness 1** to guide the elbow and arm in the correct position until it is locked again in the rest position.

In the preferred embodiment of the present invention, the arm elevator harness fits around the pitchers upper body and is attached with velcro straps. The arm and elbow elevator guide is made of plastic and elevates the pitcher's elbow and arm to shoulder height or above for all of the reasons mentioned previously. The shoulder portion of the harness and the arm and elbow elevator are preferably made of plastic. The springs of the arm and elbow elevator are preferably made of steel.

What is claimed is:

1. A pitcher's training device for training baseball pitchers the correct arm and elbow action when pitching a baseball comprising: an arm elevator harness which fits around the pitcher's upper body; an arm and elbow elevator guide connected to said harness at a position under the pitcher's throwing arm in a manner to allow for movement of the arm and elbow elevator guide in an elyptical fashion, said arm and elbow elevator guide comprising a first outer portion which contacts and guide said pitching arm and a second inner portion movably attached to the harness and said outer portion being connected to said inner portion by a spring hinge mechanism for pivotally biasing said outer portion away from said inner portion and to an arm supporting position, means for releasably holding said outer portion in an inactive position whereby said outer portion is held substantially parallel to said inner portion, said releasably holding means releasing said outer portion when contacted by a pitcher's arm at the start of movement of the arm when a pitcher moves his arm in a proper ball pitching motion.

2. A pitchers training device for training baseball pitchers the correct arm and elbow action when pitching a baseball comprising: an arm elevator harness which fits around a pitcher's upper body and is firmly attached thereto; and arm and elbow elevator guide connected to the harness at a position under a pitcher's throwing arm, said elevator guide being connected to said harness by a track means to facilitates movement of the arm and elbow elevator guide in an elyptical fashion, said arm and elbow elevator guide comprising a first elongated outer portion which elevates and guides a pitching arm during a pitching motion and a second elongated inner portion attached to said harness track means a latch mechanism position at one end of said inner portion for releasably holding said away from the point of connection with the shoulder harness which holds the outer and inner portions together prior to the elevation of said outer portion, said outer portion being pivotally connected to the other by means of a spring end of said inner portion hinge mechanism for pivotally biasing said outer portion away from said inner portion and to an arm supporting position, said latch means releasing said outer portion when contacted by a pitcher's arm at the start of movement of the arm when a pitcher moves his arm in a proper ball pitching motion.

* * * * *